United States Patent [19]

Shockley

[11] 4,384,499

[45] May 24, 1983

[54] TOOL SET OF THE TYPE HAVING SLIDE-OUT AND SWING-OUT TOOLS

[75] Inventor: Cy Shockley, Auburn, Wash.

[73] Assignee: Harmon P. Yates, Longview, Wash.

[21] Appl. No.: 246,085

[22] Filed: Mar. 20, 1981

[51] Int. Cl.[3] ..... B25G 3/38

[52] U.S. Cl. ..... 81/440; 81/177 E

[58] Field of Search ..... 81/439, 440, 436, 177 E

[56] References Cited

U.S. PATENT DOCUMENTS

| | | | |
|---|---|---|---|
| 2,633,768 | 4/1953 | Saxby | 81/440 |
| 2,776,744 | 1/1957 | Cook | 81/439 |
| 3,943,801 | 3/1976 | Yates | 81/440 |

*Primary Examiner*—Donald R. Schran
*Attorney, Agent, or Firm*—Kolisch, Hartwell & Dickinson

[57] ABSTRACT

A multi-configurational tool device with improved tool storage. The device is of the type having a plurality of tools, each including a pair of angularly disposed, integrally joined elongate shanks having working ends and a surface run having facets. The device, additionally, has an elongate carrier including an elongate channel with a base and an open side extending longitudinally of the channel. The base cooperates with a pivot member secured to the carrier and spaced apart from the base to form a nip region through which the tool shanks are moved for positioning of the tools in a working mode. The improvement includes a groove at least partially encircling a shank of a tool to accommodate rotating of the shank about its longitudinal axis to permit a change in the extension direction of the associated integral shank.

2 Claims, 7 Drawing Figures

TOOL SET OF THE TYPE HAVING SLIDE-OUT AND SWING-OUT TOOLS

BACKGROUND AND SUMMARY OF THE INVENTION

This invention pertains to a multi-configurational tool device, and more particularly, to a tool set having a carrier unit, or carrier, for holding a plurality of tool units, or tools. Movement of each tool relative to the carrier is provided to allow alternate positioning of the tool in two working positions and a storage position.

One type of tool device to which this invention pertains is disclosed in U.S. Pat. No. 3,943,801, entitled "Tool Set With Slide-Out and Swing-Out Tools". Specifically, an elongate carrier is provided which holds a plurality of tools for use and storage in a nip region. An example of such a tool is an allen wrench which has a hexagonal cross section. As is known, such wrenches generally have interconnected long and short shank portions or shanks which are disposed substantially at right angles to each other. Although the invention will be described herein primarily with regard to allen wrenches, it should be understood that tools other than allen wrenches which have been adapted to a tool set as described herein may be constructed in accordance with this invention.

In the past, when the plurality of wrenches held by a carrier have been placed in storage positions, one shank of each wrench has extended laterally away from the body of the carrier. These extending shanks can cause wear and tear when the tool set is placed in a person's pocket. Additionally, when the shank of one wrench is extended for use, the remaining shanks can interfer with proper use of the extended shank by reducing the amount of rotational clearance of the tool set relative to nearby objects. The extending shanks also interfere with proper and comfortable grasping of the tool device when one wrench is being used.

A general object of the present invention, therefore, is to provide a novel improvement in such a tool set which allows storage without projecting shanks.

More specifically, an object of the invention is to provide an improvement in such a tool set which permits changing the extension direction of the integral shank which heretofore has extended laterally away from a carrier during storage.

A preferred embodiment of the proposed invention includes modifying a shank of each wrench so that it has a groove at least partially encircling the shank having a longitudinal axis parallel with the longitudinal axis of the carrier. This allows rotation of the shank about its longitudinal axis when the groove is disposed in the nip region. Thus, during storage, the associated shank of each wrench may be positioned adjacent an end of the carrier.

It can be seen that a tool set of the type contemplated modified in accordance with this invention allows for storage of the associated wrenches adjacent an end of the carrier rather than extending laterally away from it. Thus, the inconveniences and difficulties of a conventional tool set are overcome.

These and additional objects and advantages of the present invention will be more clearly understood from a consideration of the drawings and the detailed description of the preferred embodiment.

DETAILED DESCRIPTION OF AN EMBODIMENT OF THE INVENTION

Figures 1, 2, 3, 4, 5, 6, 7:
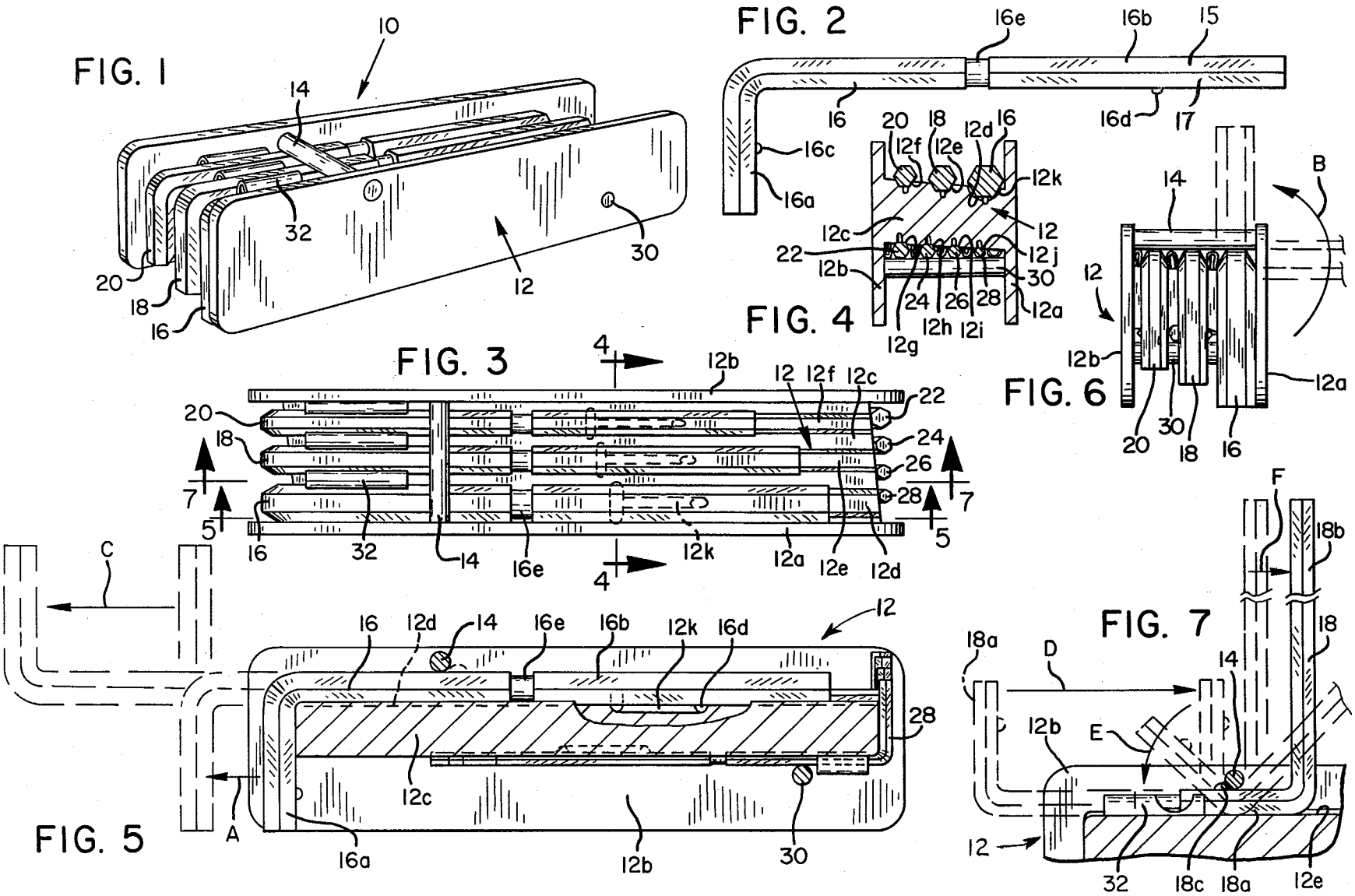
FIG. 1 is a side perspective view of a tool set constructed according to an embodiment of the invention.
FIG. 2 is a side view of a wrench removed from the tool set in FIG. 1.
FIG. 3 is a top plan view of the tool set shown in FIG. 1.
FIG. 4 is a cross sectional view taken generally along line 4—4 in FIG. 3 and rotated 90° counterclockwise.
FIG. 5 is a cross sectional view taken generally along line 5—5 in FIG. 3 showing a wrench in several different positions.
FIG. 6 is an end elevation view of the tool set taken from the left end of FIG. 5, also showing a wrench in several different positions.
FIG. 7 is a partial cross-sectional view, taken along line 7—7 in FIG. 3, further illustrating a wrench in the set in several different positions.

Referring to FIG. 1, at 10 is indicated generally a tool set, also referred to as a multi-configurational tool device, constructed according to an embodiment of the invention. The set includes an elongate carrier, or tool-holding body, shown generally at 12, a pivot member 14 which herein is a rod joined at each end to the sides of carrier unit 12, and a plurality of wrenches received by carrier 12, such as the three allen wrenches shown at 16, 18, 20.

FIG. 2 shows a side view of wrench 16. It has a first, or short, shank **16*a* to which is integrally joined and disposed at substantially a right angle to it, a second, or long, shank 16*b*. Each shank has a hexagonal cross section, and therefore a surface run with facets or planar sides running parallel with the shank's longitudinal axis. For example, shank 16*b* has six facets such as the two shown at 15, 17. Each shank also has a projection or knob, such as knobs 16*c*, 16*d* on shanks 16*a*, 16*b*, respectively located on one of the planar sides in a position spaced intermediate the shank's ends. Longer shank 16*b* is constructed with a groove 16*e* encircling it intermediate knob 16*d* and the end joining shank 16*a*. Groove 16*e*** is also referred to herein as groove means.

Referring now to FIGS. 3 and 4, in addition to wrenches 16, 18, 20 on the top side of carrier 12 as illustrated in FIG. 1, a second set of wrenches 22, 24, 26, 28 is received on the bottom side of carrier 12. The cross-sectional sizes of the wrenches diminish progressing successively from wrench 16 to wrench 28. The outer ends of each of the shanks on each wrench which would be inserted into the hexagonal cavity in an allen-head screw are referred to herein as the working portions of the associated shanks of the wrenches.

A pivot member 30, associated with wrenches 22, 24, 26, 28, is disposed between the sides of carrier 12 as shown.

Describing carrier 12, a pair of elongate, substantially planar, parallel, laterally spaced sides **12*a*, 12*b* have interposed integrally between them an elongate rectangular base 12*c*. Referring specifically to FIG. 4, top and bottom surfaces of base 12*c* have a plurality of substantially parallel, flat-bottomed grooves 12*d*, 12*e*, 12*f*, 12*g*, 12*h*, 12*i*, 12*j* which extend fully longitudinally of base 12*c*, and which are adapted to receive and support a planar side of wrenches 16, 18, 20, 22, 24, 26, 28, respectively. Base 12c** is also referred to herein as an elongate shank support member.

Sides 12a, 12b and base 12c define a pair of elongate channels extending longitudinally of carrier 12 for receipt of the corresponding wrenches. Each channel is open along a side of carrier 12 opposite base 12c.

Plural elongate spring clips, such as clip 32, are disposed between adjacent wrenches. These clips have a somewhat U-shaped cross section, are secured to base 12c, and project outwardly as shown. The spring clips frictionally and yieldably engage sides of wrenches to hold them in a selected position within carrier 12 as will be explained in greater detail below.

Pivot members 14, 30 extend laterally of carrier 12, and are joined at essentially right angles to the planees of sides 12a, 12b. Pivot members 14, 30 are spaced apart from base 12c so that wrenches nesting in their respective base grooves each have a planar surface adjacent the planar surface of the groove and an opposite planar surface touching the associated pivot member. The pivot members and base grooves thereby cooperate to form nip regions with respect to the wrenches disposed therebetween. Thus, with such contact existing, the wrenches may slide longitudinally of carrier 12 but may not rotate about a shank's longitudinal axis.

The wrenches, as illustrated in FIGS. 1, 3 and 4, are in what is referred to herein as stored positions, with their longer shanks positioned within grooves in base 12c, and with the shorter shanks adjacent an end of base 12c. In this position, the knob on each longer shank is received in a generally T-shaped cavity formed in the associated base groove. As an example, a cavity 12k is shown on FIGS. 3, and 4 formed in base groove 12d. Knob 16*d* projects into the right end of cavity 12k. The cavity includes an elongate portion extending horizontally in FIG. 3 with a longitudinal axis essentially parallel with the longitudinal axis of groove 12d. The left end of the elongate portion of cavity 12k joins with an arcuate portion extending transversely of groove 12d which appears as the T cap in FIG. 3.

Explaining the operation of tool set 10, and referring to FIGS. 5 and 6, wrench 16 is in a stored position, as shown by the solid lines. Shank 16b is received within groove 12d with knob 16d disposed in cavity 12k, as just explained. In order to put wrench 16 into a working position, shank 16b is first slid to the left, as shown by arrow A in FIG. 5, along its longitudinal axis until shank groove 16e is aligned with pivot member 14. Cavity 12k has been formed so that knob 16d is now disposed in the cavity's arcuate portion.

Referring now to FIG. 6, shank 16b is rotated about its longitudinal axis with knob 16d moving through the arcuate portion of cavity 12k, until shank 16a extends upwardly as shown by arrow B in FIG. 6. Shank 16b is again slid to the left in groove 12d along its longitudinal axis, as shown by arrow C in FIG. 5, until knob 16d abuts pivot member 14. Wrench 16 is now in a position facilitating use of the working portion of shank 16a. It can be seen that wrench 16 is the only wrench having a shank portion extending beyond the confines of carrier 12.

Although wrench 16 has been used for this discussion, the description applies equally well to the other wrenches.

A second working position is also provided. When the region of joinder of the two shanks of a wrench are positioned adjacent the pivot member, the shank within the base groove is lifted away (rotated) from the base until the associated shank seats in the same groove. This is illustrated in FIG. 7 which shows in broken lines in the left-most position, wrench 18 after it has been removed from its storage position and rotated so that shank portion 18a is extending upward as was previously described for wrench 16 by arrows A and B in FIG. 5. Shank 18b is slid longitudinally as shown by arrow D until shaft 18a abuts pivot member 14. Shaft 18b is then rotated out of groove 12e in a plane parallel to the plane of FIG. 7 until shaft 18a is positioned within groove 12e, as shown by arrow E. In this position, shank 18b is extending in a direction normal to its previous direction. Shaft 18a may be slid along groove 12e until knob 18c abuts pivot member 14. With longer shank 18b extending outwardly away from carrier 12 its working portion is now available for use.

Each wrench in set 10 may therefore be held in a stored position generally conforming to the associated perimeter of base 12c or shifted into two working positions, one with the shorter shank extending outwardly from carrier 12, and the other with the longer shank extending outwardly therefrom. In each of these positions, the wrench is disposed between spring clips and also held in a nip region existing between a pivot member and base 12c, to hold the wrench firmly for convenient operation by the user.

It can therefore be seen that a tool set of the type described, which has been modified in accordance with this invention, provides a means of storage which enhances use of the tool set as well as its storage.

While the invention has been particularly shown and described with reference to the foregoing preferred embodiment, it will be understood by those skilled in the art that other changes in form and detail may be made therein without departing from the spirit and scope of the invention as defined in the following claims.

It is claimed and desired to secure by Letters Patent:

1. A multiconfigurational tool device comprising an elongate carrier unit including means therein defining a nip region, at least one tool unit carried by said carrier unit including a pair of angularly disposed integrally joined elongate shank portions having working ends each operable in a working mode with rotation of the associated shank portion about its longitudinal axis as a unit with said carrier unit, each shank portion including a surface run having facets enabling movement of the shank portion longitudinally relative to said nip region while inhibiting rotation of the shank portion about its longitudinal axis relative to the nip region, and further enabling shifting of said tool unit under a circumstance with the region of joinder of said shank portions disposed in said nip region permitting alternate positioning of each shank portion within said nip region, and groove means formed transversely on, and interrupting a facet in, at least one of said shank portions, operable when disposed in said nip region, through cooperation therewith, to accommodate rotation of said one shank portion relative to said carrier unit about the shank portion's longitudinal axis.

2. An improved tool set of the type having a plurality of tool units, each unit including a pair of integrally joined elongate shank portions disposed at a substantial angle relative to one another, with each shank portion having a working end, and with one shank portion in each tool being characterized by a facet extending substantially along its length, said set also having an elongate tool-holding body including an elongate shank portion support member extending longitudinally of said body for receiving said tool units, and having a pivot member secured to said body, spaced outwardly from said support member and overlying, transversely, the facet in the one shank portion of each tool unit to permit longitudinal adjustment of the tool unit relative to said body, while inhibiting rotation of the tool unit about the long axis of the one shank portion, wherein the improvement comprises means in the form of a groove in the facet of each said one shank portion, coactible with said pivot member to accommodate such rotation of the one shank portion of each tool unit about the one shank portion's long axis to permit a change in the extension direction of the associated integral shank portion.

* * * * *